US009657991B2

(12) United States Patent
Hallac et al.

(10) Patent No.: US 9,657,991 B2
(45) Date of Patent: May 23, 2017

(54) MICROWAVE T-JUNCTION APPLICATOR

(75) Inventors: Abdulkadir Hallac, Morrisville, NC (US); Michael W. Bumgardner, Raleigh, NC (US)

(73) Assignee: Industrial Microwave Systems, L.L.C., Harahan, LA (US)

( * ) Notice: Subject to any disclaimer, the term of this patent is extended or adjusted under 35 U.S.C. 154(b) by 1955 days.

(21) Appl. No.: 12/376,794

(22) PCT Filed: Aug. 27, 2007

(86) PCT No.: PCT/US2007/076875

§ 371 (c)(1),
(2), (4) Date: Feb. 9, 2009

(87) PCT Pub. No.: WO2008/027826

PCT Pub. Date: Mar. 6, 2008

(65) Prior Publication Data

US 2010/0163555 A1 Jul. 1, 2010

Related U.S. Application Data

(60) Provisional application No. 60/824,347, filed on Sep. 1, 2006.

(51) Int. Cl.
*H05B 6/78* (2006.01)
*F27B 9/36* (2006.01)
(Continued)

(52) U.S. Cl.
CPC ..... *F27B 9/36* (2013.01); *F27D 99/0001* (2013.01); *F27B 9/243* (2013.01); *F27D 2099/0028* (2013.01)

(58) Field of Classification Search
CPC ..... H05B 6/782; H05B 6/78; A23L 3/01
(Continued)

(56) References Cited

U.S. PATENT DOCUMENTS 2,584,162 A * 2/1952 Sensiper et al. ..... 333/125
2,866,166 A 12/1958 Zaleski
(Continued)

OTHER PUBLICATIONS

Roger Meredith, "Engineers' Handbook of Industrial Microwave Heating," pp. 131-133; 1998, The Institution of Electrical Engineers, London, GB.

*Primary Examiner* — Tu B Hoang
*Assistant Examiner* — Thomas Ward
(74) *Attorney, Agent, or Firm* — James T. Cronvich

(57) ABSTRACT

A T-junction microwave applicator and a method for making a T-junction microwave applicator with a microwave source supplying electromagnetic energy through a junction arm to a pair of collinear arms extending in opposite directions from their junction with the junction arm. The two collinear arms form a main waveguide terminated in end walls in which entrance and exit ports are formed for a conveyor to convey material to be heated through the main waveguide for exposure to electromagnetic energy. A rectangular conductive ridge in the wall of the main waveguide opposite the junction arm extends the length of the applicator. A cylindrical tuning bar spanning the junction is positioned vertically in a plane perpendicular to the axis of the main waveguide to maximize power transfer to the material to be heated.

15 Claims, 2 Drawing Sheets

(51) Int. Cl.
*F27D 99/00* (2010.01)
*F27B 9/24* (2006.01)

(58) Field of Classification Search
USPC ..... 219/691, 690, 693, 697, 756; 333/125, 333/137
See application file for complete search history.

(56) References Cited

U.S. PATENT DOCUMENTS

| | | | | |
|---|---|---|---|---|
| 3,397,296 | A | 8/1968 | Curran | |
| 3,749,874 | A * | 7/1973 | Edgar | 219/699 |
| 3,806,837 | A * | 4/1974 | Carr et al. | 333/1.1 |
| 4,275,283 | A * | 6/1981 | Focht | 219/696 |
| 4,324,965 | A * | 4/1982 | Naumann et al. | 219/696 |
| 4,570,045 | A | 2/1986 | Jeppson | |
| 5,047,738 | A * | 9/1991 | Wong et al. | 333/113 |
| 5,543,605 | A * | 8/1996 | Kimrey et al. | 219/690 |
| 5,834,744 | A | 11/1998 | Risman | |
| 7,034,266 | B1 * | 4/2006 | DeGroot et al. | 219/700 |
| 7,470,876 | B2 | 12/2008 | Drozd et al. | |

* cited by examiner

MICROWAVE T-JUNCTION APPLICATOR

BACKGROUND

The invention relates generally to microwave heating, curing, and drying devices and, more particularly, to microwave applicators in which two collinear arms of a waveguide T-junction form an exposure tunnel through which materials are conveyed and subjected to uniform microwave exposure.

In many continuous-flow microwave ovens, a planar product or a bed of material passes through a waveguide applicator in or opposite to the direction of wave propagation. These ovens are typically operated in the $TE_{10}$ mode to provide a peak in the heating profile across the width of the waveguide applicator midway between its top and bottom walls at product level. This makes it simpler to achieve relatively uniform heating of the product. But $TE_{10}$-mode applicators are limited in width. Accommodating wide product loads requires a side-by-side arrangement of individual slotted $TE_{10}$ applicators or a single wide applicator. The side-by-side arrangement is harder to build and service than a single wide applicator, but wide applicators support high order modes, which can be difficult to control. The result is non-uniform heating across the width of the product. Another problem is that the dielectric properties of materials to be heated vary with thickness and moisture content, for example, and from one material to another. Many microwave oven configurations are highly sensitive to the dielectric properties of material loads and are tailored to heat specific materials. These ovens may not heat other materials well. Furthermore, tuning microwave oven cavities to reduce reflections and to maximize power transfer to the load is often difficult with stub tuners that extend into the cavities.

Thus, there is a need for a continuous-flow microwave oven capable of uniformly heating a range of material loads across the width of the oven and that is easy to tune for a range of materials.

SUMMARY

This need and other needs are satisfied by a microwave applicator embodying features of the invention. In one aspect of the invention, a T-junction microwave applicator comprises a main waveguide having a first arm and a second arm extending in opposite directions along a main axis from a central junction to distal end walls. Each end wall has a port through which material to be heated is conveyed along the main waveguide. A junction arm extends perpendicularly from the main waveguide at the junction. Electromagnetic energy is supplied to the main waveguide through the junction arm. The main waveguide includes a conductive ridge disposed opposite the junction arm. The ridge extends along the main waveguide between the end walls of the first and second arms.

In another aspect of the invention, a microwave applicator comprises a rectangular main waveguide that extends in length from a first end wall having an entrance port to a second end wall having an exit port, in height from a bottom wall to a top wall having an opening, and in width from a first side wall to a second side wall and a microwave source emitting electromagnetic energy. A rectangular waveguide segment disposed between the microwave source and the top wall of the main waveguide at the opening couples the electromagnetic energy into the main waveguide. The waveguide segment has a first pair of opposite outer walls continuous with the first and second side walls of the main waveguide to form opposite inverse T-shaped side walls of the applicator and a second pair of opposite outer walls that extend outward of the top wall of the main waveguide. A conveyor extends along the length of the main waveguide through the entrance and exit ports to convey material to be heated through the main waveguide. A rectangular ridge stands up from the bottom wall and extends along the length of the main waveguide between the first and second side walls.

In yet another aspect of the invention, a method is provided for constructing a microwave applicator by using a waveguide T junction having two collinear arms perpendicular to a junction arm at a junction. The method comprises: (a) terminating the two distal ends of the collinear arms of a rectangular waveguide T junction in end walls having ports therethrough to form a heating tunnel through which a material to be heated may be conveyed along the tunnel in a conveying direction through the ports; (b) connecting a microwave generator to the distal end of the junction arm of the waveguide T junction to supply microwave energy to the heating tunnel; and (c) positioning a conductive rectangular ridge having preselected dimensions and extending in the conveying direction along the heating tunnel so that the material to be heated is disposed between the ridge and the junction arm.

BRIEF DESCRIPTION OF THE DRAWINGS

These features and aspects invention, as well as its advantages, are better understood by reference to the following description, appended claims, and accompanying drawings, in which:

DETAILED DESCRIPTION

Figure 1:
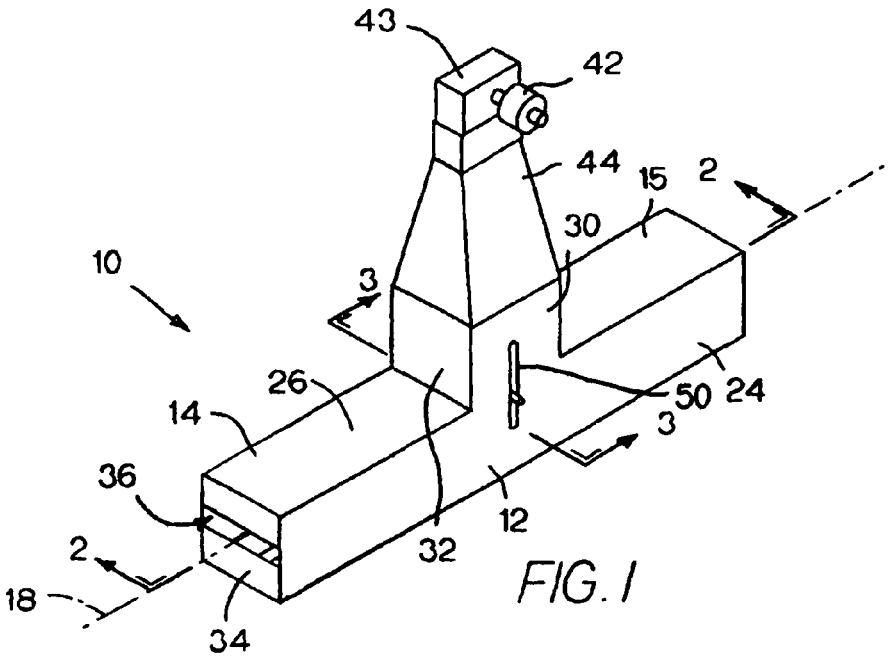
FIG. 1 is an isometric view of a microwave applicator embodying features of the invention.
Figure 2:
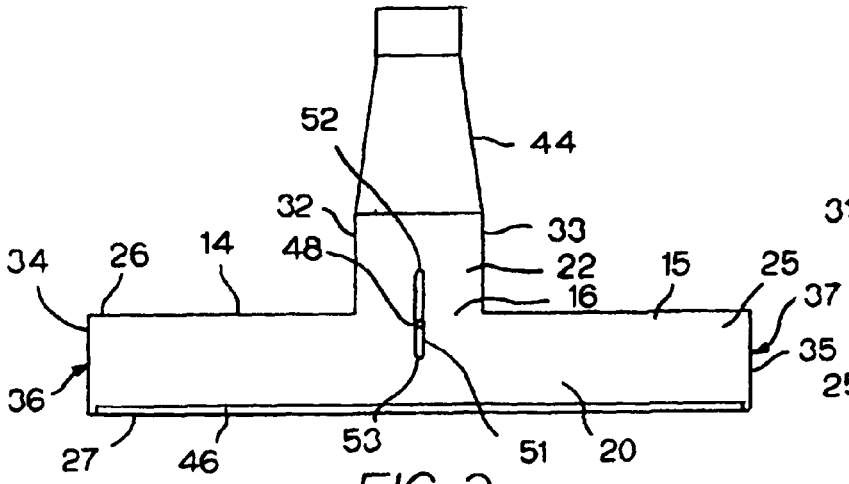
FIG. 2 is a longitudinal cross sectional view of the microwave applicator of FIG. 1 taken along lines 2-2 of FIG. 1 with the microwave source omitted.
Figure 3:
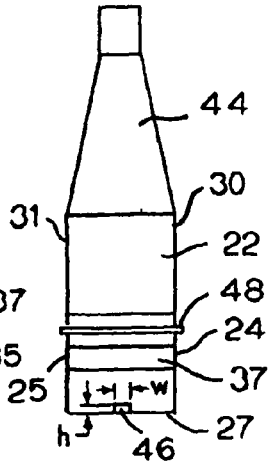
FIG. 3 is a transverse cross sectional view of the microwave applicator of FIG. 1 taken along lines 3-3 of FIG. 1 with the microwave source omitted.
Figure 4:
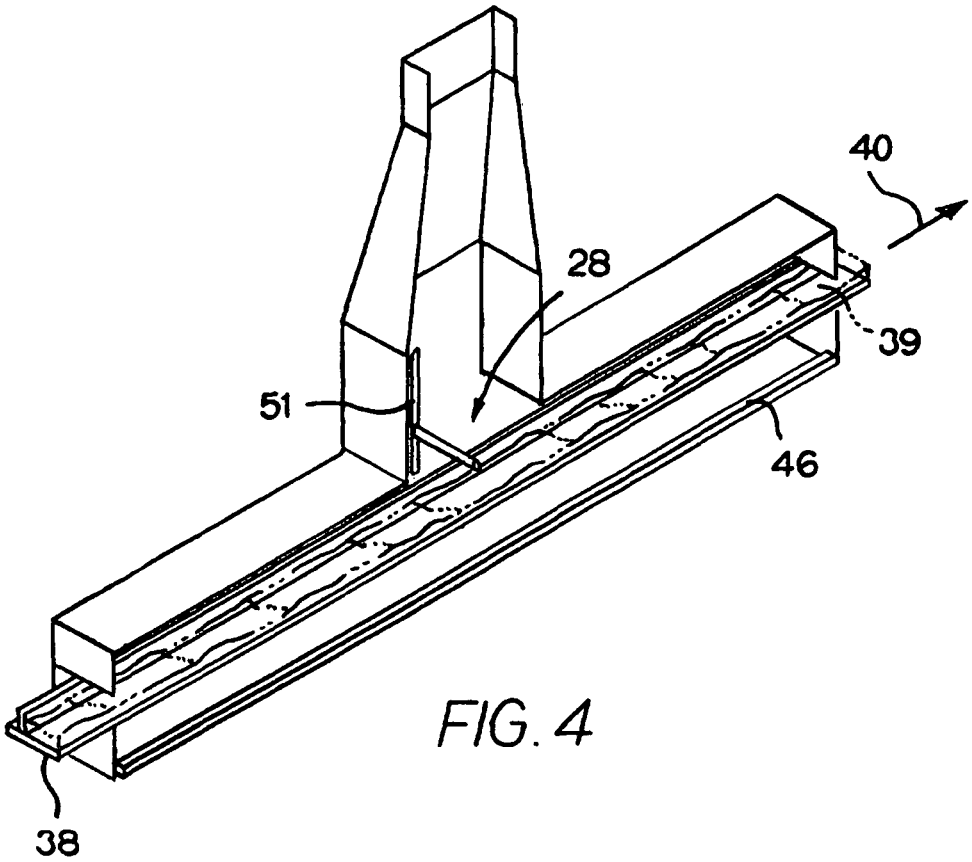
FIG. 4 is an isometric view of the longitudinal cross section of FIG. 2 also showing a material being conveyed through the applicator.
Figure 5:
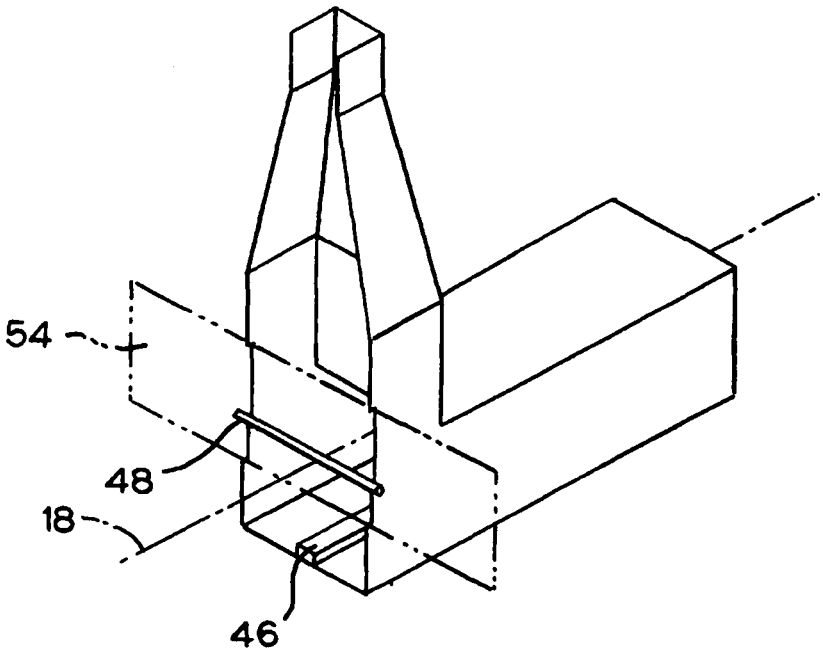
FIG. 5 is an isometric view of the transverse cross section of FIG. 3.

A microwave applicator embodying features of the invention is shown in FIGS. 1-5. The applicator 10 is a waveguide T junction 12 having a pair of collinear arms 14, 15 extending in opposite directions from a central junction 16 along a main axis 18 to form a main waveguide 20. A junction arm 22, in the form of a rectangular waveguide segment, extends perpendicularly from the main waveguide at the junction. The main waveguide is rectangular with opposed first and second side walls 24, 25 across its width and opposed top and bottom walls 26, 27 defining the waveguide height. The junction arm communicates with the two collinear arms through an opening 28 in the top wall of the main waveguide. Two opposed outer walls 30, 31 of the junction arm form continuous opposed inverse T-shaped side walls with the side walls of the main waveguide. Another pair of outer walls 32, 33 of the junction arm extend upward from the top wall of the main waveguide at right angles. The two collinear arms terminate in distal end walls 34, 35.

Consequently, the main waveguide can be operated as a resonant cavity. An entrance port 36 in the first end wall 34 and an exit port 37 in the second end wall 35 provide access for a conveyor 38, such as belt conveyor, to continuously convey a material 39 into, through, and out of the main waveguide in a conveying direction 40.

A microwave source 42, such as a magnetron, emits electromagnetic energy at a selected frequency and power level into the applicator through a launcher 43. A tapered waveguide section 44 leads from the launcher to the junction arm 22, which has an expanded cross section. The tapered waveguide section facilitates the build-up of higher order modes of the electromagnetic field, which are supported in the main waveguide 20, which acts as an electromagnetic exposure tunnel through which material to be heated is conveyed. The electromagnetic energy enters the main waveguide from the junction arm through the opening 28 in the top wall 26 to heat the conveyed material.

A conducting ridge 46 extends along the length of the bottom wall 27 in the interior of the main waveguide 20. The conductive ridge, which is shown to be rectangular in cross section, is used to tailor the shape of the electromagnetic filed pattern to achieve uniform heating across the width of the main waveguide. The ridge may be a solid metal plate, a hollow metal tube, or a metal inverted U beam. Alternatively, the ridge may be formed as a step in the bottom wall of the main waveguide. Changing the width w of the ridge changes the concentration of the electromagnetic power density across the width of the main waveguide. Because the geometry of the main waveguide, the frequency of the microwave source, and the dielectric characteristics of the material load all affect the electromagnetic field pattern in the main waveguide, the width of the ridge can be selected to make the heating pattern across the width of the main waveguide more uniform for a given range of materials or material properties. For an operating frequency of 915 MHz and a main waveguide of width 12 inches (30.5 cm), a range of ridge widths w between 1 inch (2.5 cm) and 6 inches (15.2 cm) is preferred. The height h of the ridge is used to change the power density across the width of the main waveguide for more uniform heating of the conveyed material. For an operating frequency of 915 MHz and a main waveguide of height of 12 inches (30.5 cm), a range of ridge heights h between 0.5 inches (1.3 cm) and 4 inches (10.2 cm) is preferred. (Because the material is conveyed along the length of the main waveguide, heating uniformity along the length is not generally so important as along the width.)

The T-junction applicator inherently splits the power entering the junction arm 22 into each of the two collinear arms 14, 15 forming the main waveguide 20. If the lengths of the two collinear arms are equal and the loads in each arm are equal, the power will divide evenly between the two arms. Maximizing the power delivered to the load increases the efficiency of the applicator. A tuning bar, in the form of a conductive cylinder 48, spans the junction 16 of the T-junction applicator from the opposed inverted T-shaped outer walls of the applicator. Vertical slots 50, 51 in those outer walls receive the ends of the tuning bar and provide it a wide range of adjustment positions from a highest position 52 in the junction arm to a lowest position 53 in the main waveguide and closest to the conducting ridge 46. The slots are preferably at least 8 inches (20.3 cm) long with their lowest position 53 no closer than about 3 inches (7.6 cm) from the conducting ridge 46. The slots define a plane 54 that is perpendicular to the main axis 18 or length of the main waveguide. The tuning bar lies in that plane, which is generally midway between the two length-spaced outer walls 32, 33 of the junction arm 22. The slotted arrangement allows the tuning bar to be moved up and down the slot easily to match the load to the microwave source for maximum power transfer.

In the description of the preferred version of the invention, terms such as "height," "length," "width," "vertical," "top," "bottom," and perhaps others were used for convenience in describing relative positions in a typical layout. For the purposes of the claims, the terms are meant only in a relative sense and should not be used to limit the claimed applicator to a specific geodetic orientation.

What is claimed is:

1. A T-junction microwave applicator comprising:

a rectangular main waveguide of uniform width comprising a first arm and a second arm extending in opposite directions along a main axis from a central junction to distal end walls, each end wall having a port;

a conveyor disposed to convey material to be heated along the main waveguide entering through one of the ports and exiting out the other port;

a junction arm extending perpendicularly from the main waveguide at the junction through which electromagnetic energy is supplied to the main waveguide, wherein the junction arm forms a three-arm T junction with the first and second arms of the main waveguide;

wherein the main waveguide includes a conductive ridge disposed opposite the junction arm and extending in length through and past the junction along the lengths of the first and second arms of the main waveguide between the end walls to achieve uniform heating across the width of the main waveguide along its length.

2. A T-junction microwave applicator as in claim 1 further comprising a conductive bar spanning the junction between the first and second arms and the junction arm and adjustable toward and away from the conductive ridge along a plane perpendicular to the main axis.

3. A T-junction microwave applicator as in claim 2 wherein the conductive bar is cylindrical.

4. A T-junction microwave applicator as in claim 2 wherein the main waveguide and the junction arm are slotted with a pair of slots in the applicator disposed opposite each other across the junction in the plane to receive the conductive bar and provide a range of adjustable positions for the conductive bar in the junction.

5. A T-junction microwave applicator as in claim 4 wherein the slots are at least 8 inches in length.

6. A T-junction microwave applicator as in claim 4 wherein the slots extend away from the junction arm to ends that allow the conductive bar to be positioned no closer than 3 inches to the ridge.

7. A T-junction microwave applicator as in claim 1 wherein the conductive ridge is rectangular in cross section with a height h and a width w, wherein 0.5 inches<h<4 inches and 1 inch<w<6 inches.

8. A method for constructing a microwave applicator using a waveguide T junction having two uniform-width collinear arms perpendicular to a junction arm at an intermediate junction, the method comprising:

terminating the two distal ends of the uniform-width collinear arms of a rectangular waveguide T junction in end walls having ports therethrough to form a heating tunnel through which a material to be heated may be conveyed along the tunnel in a conveying direction through the ports;

connecting a microwave generator to the distal end of the junction arm of the waveguide T junction to supply microwave energy to the two collinear arms of the heating tunnel only through the intermediate junction;

positioning a conductive rectangular ridge having preselected dimensions and extending in the conveying direction through and past the intermediate junction along the lengths of the two collinear arms of the heating tunnel so that the material to be heated is disposed between the ridge and the junction arm when at the intermediate junction.

9. The method of claim 8 further comprising:

positioning a conductive bar in a plane perpendicular to the conveying direction at a selectable distance from the rectangular ridge.

10. A microwave applicator comprising:

a rectangular main waveguide extending in length from a first end wall having an entrance port to a second end wall having an exit port, in height from a bottom wall to a top wall having an opening, and in width from a first side wall to a second side wall, wherein the opening is located midway between the first and second end walls and wherein the width is uniform along the length;

a microwave source emitting electromagnetic energy;

a rectangular waveguide segment disposed between the microwave source and the top wall of the main waveguide at the opening to couple the electromagnetic energy from the microwave source into the main waveguide and having a first pair of opposite outer walls continuous with the first and second side walls of the main waveguide to form opposite inverse T-shaped side walls of the applicator and a second pair of opposite outer walls extending outward of the top wall of the main waveguide;

a conveyor extending along the length of the main waveguide through the entrance and exit ports to convey material through the main waveguide to be heated along the entire length of the main waveguide further comprising a conductive ridge upstanding from the bottom wall and extending along the length of the main waveguide between the first and second side walls and from the first end wall to the second end wall.

11. A microwave applicator as in claim 10 further comprising a conductive bar extending across the width of the applicator in a plane perpendicular to the length of the main waveguide midway between the second pair of opposite outer walls of the waveguide segment.

12. A microwave applicator as in claim 11 wherein the inverse T-shaped side walls have opposed slots disposed in the plane, the slots extending from an upper end in the waveguide segment to a lower end in the main waveguide, wherein the slots receive opposite ends of the conductive bar and provide a range of adjustment positions for the conductive bar along the slots for tuning the microwave applicator.

13. A microwave applicator as in claim 10 wherein the conductive ridge is rectangular in cross section with a height h and a width w, wherein 0.5 inches<h<4 inches and 1 inch<w<6 inches.

14. A microwave applicator as in claim 10 wherein the conveyor is a belt conveyor.

15. A T-junction microwave applicator as in claim 1 wherein the first and second arms of the main waveguide are the same length.

* * * * *